US005709536A

United States Patent [19]

Renfro et al.

[11] Patent Number: 5,709,536

[45] Date of Patent: Jan. 20, 1998

[54] HYDRO MECHANICAL PACKINGLESS PUMP AND LIQUID SPRAY SYSTEM

[75] Inventors: Wesley E. Renfro, Rosenberg; Marty H. Hopkins, Richmond; Michael T. Sample, Taylor Lake Village; James N. Skarzynski, Rosenberg, all of Tex.

[73] Assignee: Titan Tool, Inc., Oakland, N.J.

[21] Appl. No.: 379,917

[22] Filed: Jan. 30, 1995

[51] Int. Cl.[6] ..... F04B 9/08

[52] U.S. Cl. ..... 417/383; 417/362; 417/472; 137/454.4; 137/512

[58] Field of Search ..... 417/362, 383, 417/389, 394, 472, 375, 405; 137/454.4, 512, 884

[56] References Cited

U.S. PATENT DOCUMENTS

| | | | |
|---|---|---|---|
| 2,216,374 | 10/1940 | Martin . | |
| 2,317,073 | 4/1943 | Martin . | |
| 2,871,789 | 2/1959 | Kiffer et al. . | |
| 2,877,799 | 3/1959 | Hildenbrandt, Jr. . | |
| 2,959,358 | 11/1960 | Vork . | |
| 3,000,320 | 9/1961 | Ring . | |
| 3,052,259 | 9/1962 | Van der Velden . | |
| 3,059,667 | 10/1962 | Cocenno . | |
| 3,168,045 | 2/1965 | Sebastiani . | |
| 3,176,713 | 4/1965 | McDermott et al. . | |
| 3,379,376 | 4/1968 | Williams et al. . | |
| 3,395,890 | 8/1968 | Eckert et al. . | |
| 3,406,402 | 10/1968 | Griebel et al. . | |
| 3,406,633 | 10/1968 | Schomburg . | |
| 3,496,874 | 2/1970 | Findlay | 417/383 |
| 3,787,149 | 1/1974 | Dane et al. . | |
| 3,863,504 | 2/1975 | Borsanyi . | |
| 4,126,321 | 11/1978 | Harjar et al. . | |
| 4,146,334 | 3/1979 | Farrell . | |
| 4,197,875 | 4/1980 | Schieferstein et al. . | |
| 4,364,520 | 12/1982 | Weber, Sr. . | |
| 4,556,196 | 12/1985 | Nimberger . | |
| 4,560,109 | 12/1985 | Teruyuki et al. . | |
| 4,667,774 | 5/1987 | Macchi . | |
| 4,778,347 | 10/1988 | Mize . | |
| 4,948,349 | 8/1990 | Koiwa . | |
| 4,974,628 | 12/1990 | Terpermeister et al. | 137/454.4 |
| 5,002,662 | 3/1991 | Ledtje et al. | 137/512 |
| 5,094,402 | 3/1992 | Perrett, Jr. et al. . | |
| 5,096,392 | 3/1992 | Wilden . | |
| 5,169,296 | 12/1992 | Kemp . | |
| 5,170,989 | 12/1992 | Wilden . | |
| 5,171,129 | 12/1992 | Vincent | 417/383 |
| 5,378,122 | 1/1995 | Duncan . | |
| 5,480,292 | 1/1996 | Chevallier . | |

*Primary Examiner*—Charles G. Freay
*Attorney, Agent, or Firm*—Dickstein Shapiro Morin & Oshinsky LLP

[57] ABSTRACT

A liquid pumping, handling and spraying system for liquid compositions and especially those liquid coating compositions having a suspension of metal particulate therein which tends to settle out of suspension of metal particulate therein which tends to settle out of suspension quite rapidly and which includes metal particulate having an affinity for adherence to metal surfaces. A fluid supply system is provided which accomplishes continuous agitation of the liquid composition to sprayed to maintain the metal particulate thereof in properly entrained suspension and even distribution with the liquid carrier fluid and which permits the use of low cost, lightweight containers for the liquid supply. A packingless pump is provided for pressurized delivery of the liquid composition from the supply container to a packingless spray gun. The packingless pump achieves pumping of liquid by hydro mechanical deformation of polymer variable volume pump chambers which induce intermittent suction and pressurization of the liquid for pumping and which have externally mounted check valve heads for controlling the flowing of the pumped liquid from the supply container to the spray gun. The packingless spray gun employs a body of resilient polymer which functions as a columnar spring to control the opening and closing movement of a spray valve assembly. Valve seats of the check valve head and spray gun assembly may be of flexible nature to ensure efficient separation of metal particulate therefrom. Metal operational components of the check valve head and spray gun, such as valve stems and valves define outer surfaces composed of titanium to minimize metal particulate adherence thereto.

21 Claims, 4 Drawing Sheets

FIG. 3
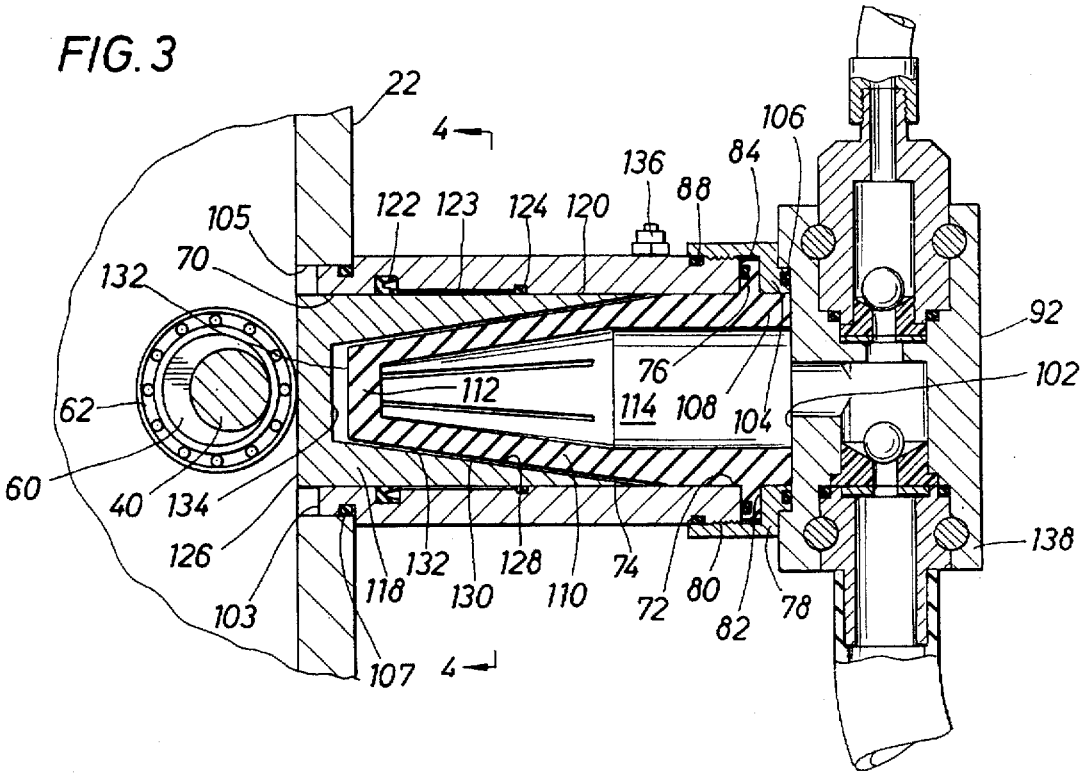
FIG. 6
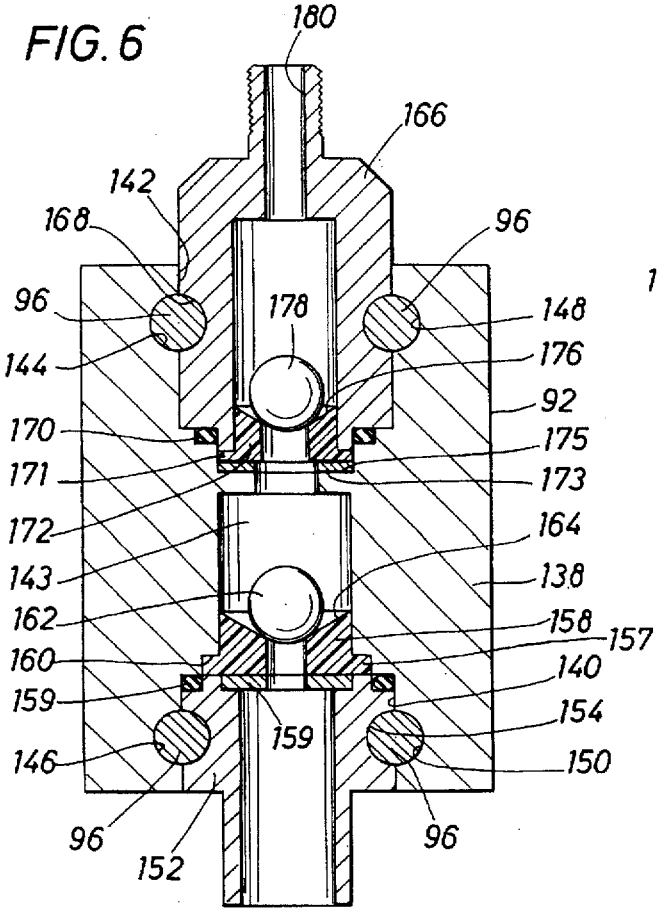
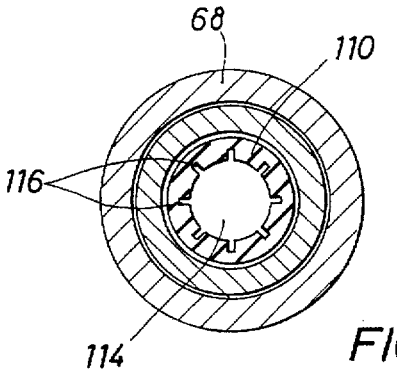
FIG. 4
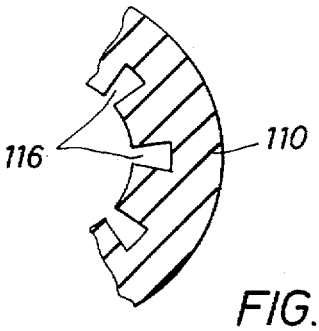
FIG. 5

FIG. 9
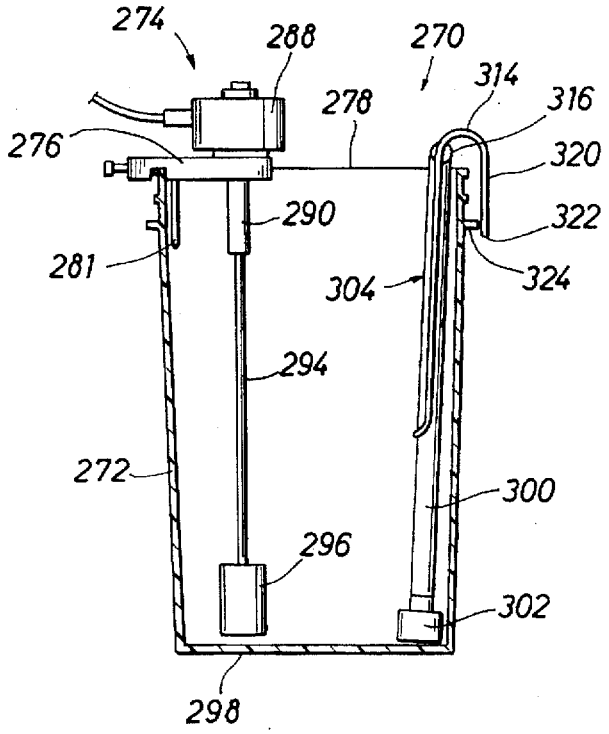
FIG. 11
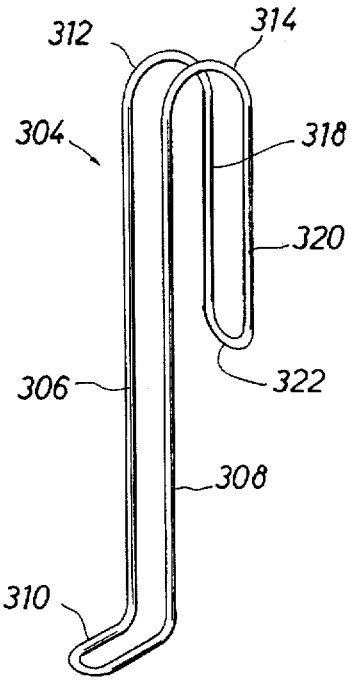
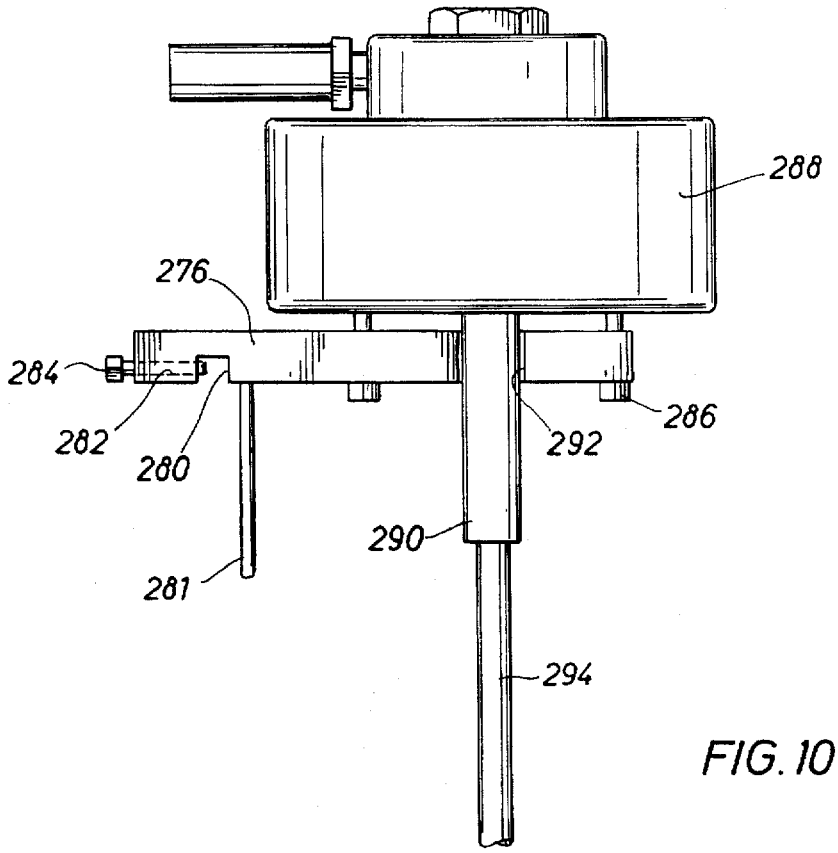
FIG. 10

HYDRO MECHANICAL PACKINGLESS PUMP AND LIQUID SPRAY SYSTEM

FIELD OF THE INVENTION

This invention relates generally to liquid spray systems such as paint and coating spray systems having liquid pumps, liquid handling apparatus and liquid spray apparatus for consistent spraying of liquid materials such as during painting and coating operations. More particularly, the present invention concerns the provision of a packingless pump and liquid spray system having the capability of effectively pumping, handling and spraying paint and other coating compositions having a liquid carrier within which is entrained a quantity of dense metallic particulate such as zinc. Even further the invention relates to apparatus for pumping and spraying of liquids containing metal particulate which has a tendency to adhere to metal surfaces, settle out of suspension in fluid handling lines and supply containers and to erode shaft packings.

BACKGROUND OF THE INVENTION

For purposes of explanation and understanding the present invention is discussed herein particularly as it relates to the pumping and spraying of a carrier/metallic particulate composition such as water based zinc coating composition. This specific discussion however is not intended to limit the present invention, it being within the spirit and scope of this invention to pump and spray a wide variety of liquid compositions having a number of different purposes.

Metallic protective coatings such as zinc coatings, for example, have in the past employed an epoxy based carrier fluid within which the metallic particulate of the coating composition is in suspension. An epoxy based carrier fluid typically has sufficient viscosity so that the minute metallic particulate, even though being very dense, are maintained in suspension within the liquid carrier for a sufficient period of time for efficient pumping, handling and spraying. Even in the case of epoxy carrier liquids, after the dense zinc particulate has been mixed therewith, the mixed carrier/coating composition must be utilized within a relatively short period of time in order to avoid separation of the zinc particulate from the liquid carrier by gravitation. Obviously, the epoxy carrier composition, once mixed, will have a relatively short period of time within which it must be used or cleared from the pumping and spraying equipment to prevent its polymerization reaction to be completed; otherwise the pumping, liquid handling and spraying equipment can become fouled with the polymerized coating composition thus requiring significant cleaning and repair.

It has been determined of late that epoxy based carriers for metallic coating compositions, paint and other such products can be hazardous to the environment. For this reason, many governmental agencies, including the Environmental Protection Agency of the United States, have announced that the epoxy based carrier fluid for metallic paints and protective coatings will soon be prohibited. The paint and coating industry, in anticipation of environmental limits on the use of epoxy based carrier fluids for coatings, has developed water based metallic coating compositions which can be successfully pumped and sprayed and which have been found to have efficient commercial results. Water based zinc coating material is an especially useful product which provides effective protective coatings for metals which are exposed to certain chemical environments or which are continuously exposed to whether at this point is water based zinc coating material considered an optimum substitute for epoxy based zinc coating compositions.

Though water based zinc coating materials can be efficiently sprayed, a number of significant disadvantages tend to exist that give rise to difficulties in pumping, handling and spraying of the same. The water based carrier is typically significantly less viscous as compared to the previously used epoxy based carrier. Consequently, the zinc particulate, being very dense, tends to fill out of suspension with the water based carrier quite rapidly and therefore must be periodically or continuously agitated in order to keep the zinc particulate in suspension so that the zinc/carrier mix remains optimum for spraying. Thus, the spray system for water based zinc coatings should be provided with means for continuously stirring the supply of zinc coating composition in order to maintain its proper consistency during pumping, handling and spraying.

Another problem that has been identified is the tendency of the zinc particulate of a water based zinc coating composition to adhere to metal surfaces. This affinity for metal particulate adherence causes the zinc particulate to adhere to and become essentially plated onto metal surface such as the internal wall surfaces of pump housings, cylinders, pistons, piston stems and check valves. The adhering zinc particulate will continuously build up on metal surfaces and into itself until it becomes quite thick. In time the metal particulate buildup will slough away and pass through liquid handling lines and spray gun nozzles as metallic globules which can interfere with smooth and even spraying activity. These metal flakes or globules sometimes bridge small openings such as the openings of spray gun nozzles so that they can become blocked to the point that disassembly and cleaning is required. Adhered metal particulate buildup on valve stems will be forced along with the valve stems to pass through packings of the pump and spray gun. This adhered material will rapidly buildup on valve stems to the point that erosion of the valve stem packings will occur in a relatively short period of time. When this happens obviously the spray pump and spray gun assembly must be disassembled and the packings must be replaced. The valve and spray gun stems may also need to be cleaned of metal buildup or may need to be replaced. The tendency of the zinc particulate to buildup on metal surfaces will also tent to cause its adherence and buildup on the check valves of a piston pump check valve head mechanism to the point that improper check valve seating will occur. When this happens obviously the check valves must be disassembled and cleaned or they must be replaced.

The tendency of zinc particulate to adhere to metal surfaces causes sufficiently rapidly deterioration of the pumps and spray gun systems of coating spraying apparatus that it is difficult to complete a days spraying activity without necessitating repair or replacement of system components. For this reason spray system down time for repair and replacement operations adds significantly to the overall cost of spraying activities for water based metal coatings.

It is desirable therefore to provide a pumping system having the capability of pumping water based zinc coating materials and other such metal coatings in a manner that overcomes the need for frequent repair or replacement of system components during use thereof. It is also desirable to provide a pump and spray system for metallic coating materials which has no pump or spray gun packings and therefore overcomes the problem of rapid packing deterioration that is prevalent in commercially available coating spray systems.

It is also desirable to provide a coating spray system having the capability of overcoming the tendency of water based metal coating material to quickly settle out of suspension after it has been mixed and has been made ready for use.

SUMMARY OF THE INVENTION

It is a principal feature of the present invention, therefore, to provide a novel spraying system having the capability of efficiently pumping and spraying metallic coating compositions such as water based zinc coating materials and which does not require frequent replacement and/or cleaning of system components during use thereof.

It is also an important feature of this invention to provide a novel spray system for metallic coating compositions having a pumping mechanism and spraying mechanism which are both of packingless nature and thus avoid the frequent packing repair or replacement that is prevalent when commercially available coating spray systems are employed for this purpose.

It is an even further feature of the present invention to provide a novel packingless metallic coating spraying system having means for continuously agitating prepared water based metallic coating materials to maintain proper metal particulate suspension for extended periods to provide for trouble free and efficient fluid pumping, handling and spraying activities.

It is another feature of this invention to provide a novel metallic coating spray system having a sealed, variable volume, non-metal deformable pump chamber having a volume that is intermittently reduced for pumping fluid therefrom and which intermittently expands to develop suction for drawing metallic coating material therein for subsequent pumping.

It is a further feature of this invention to provide a novel variable volume pump mechanism having an eccentric pumping system provided with hydraulic force transfer for efficiently collapsing a flexible tubular pump element both linearly and radially to expel liquid therefrom.

It is also a feature of this invention to provide a novel variable volume flexible pumping tube for a pump mechanism having the capability of forcible expansion due to the inherent resilient memory of the material from which it is composed so that its memory induced expansion develops a suction portion of a pumping cycle.

It is another feature of this invention to provide a novel packingless pump mechanism having a rotatable cam drive which applies pumping force to a resilient tubular pump chamber only during a pumping section of the operational cycle thereof.

It is another feature of the present invention to provide a novel spray system for metallic coating compositions and other liquid materials which incorporates pump check valves to which the metallic particulate of the coating material will have virtually no tendency for adherence during operation of the pump mechanism.

It is also a feature of the present invention to provide a novel spray system for metallic coating compositions having a packingless spray gun to eliminate the problem of packing deterioration and replacement which is inherent on conventional spray systems for spraying metallic coating material and to insure efficient spraying and proper distribution of the metallic coating compositions onto extended surfaces.

It is an even further feature of the present invention to provide a novel spray system for metallic coating compositions which achieves continuous agitation of prepared metal coating liquid both in a liquid supply reservoir and in liquid supply and distribution conduits to thus insure proper maintenance of metallic particulate suspension during handling, pumping and spraying activities.

Briefly a water based zinc or other metallic coating composition or other liquid materials being sprayed will, according to the teachings of the present invention incorporate a simple low cost container for the prepared metallic coating composition to which a motor driven stirrer mechanism may be efficiently attached. The motor drive for the liquid agitation mechanism may conveniently take the form of a pneumatic motor which is driven by an air supply since electric power may not be available or convenient where coating spray systems are being employed. The agitating mechanism operates continuously to maintain proper suspension of the metallic particulate within the carrier liquid. A filtered suction assembly is also provided for simple and efficient support and positioning relative to the coating supply container and is secured against one side of the container by a support and positioning stabilizing clip so that the filter of the suction tube remains separated from the rotating agitation impeller that is present in the container.

The suction line of the agitated supply container is coupled to a valve controlled inlet of one of a plurality of check valve head assemblies with which the pump mechanism is provided, there being a check valve head for each pumping chamber of the pump. Thus, the coating composition is drawn from the supply container into the inlet port of the check valve head assembly and passes through the suction check valve during the suction stroke or portion of the pump cycle. From the inlet or suction check valve the liquid coating composition is conducted by suction into the variable volume pumping chamber of a generally tubular pump element composed of a generally rubber-like polymer material such as polyurethane. This resilient pumping tube defines an open end in communication with the fluid flow passages of the check valve assembly and defines a closed end which faces away from the check valve assembly. The closed end of the resilient pumping tube is received within a tube pusher element which is in contact with the external roller needle bearing of a rotating eccentric cam of a cam shaft that is rotatably supported by a pump support housing structure. The rotatable cam shaft is driven by a reduction gear system operated by an air motor or other suitable rotatable drive mechanism. The air motor will be connected in driving relation with the reduction gear system by a drive sheave and belt assembly which induces rotation to an idler shaft having a reduction drive gear fixed thereto or machines thereon. As the eccentric cam is rotated, a needle bearing assembly surrounding the eccentric will apply a unidirectional force to the pusher element to accomplish the pumping section of the pump cycle. Though eccentric cam actuation of the pusher element is discussed specifically herein, it should be borne in mind that the pusher may be linearly actuated in any other suitable manner such as by a hydraulic or pneumatic piston actuator, for example.

A typical metallic coating spray pump constructed in accordance with this invention will have a pair of opposed deformable pump chambers such as that described above each being supported on opposite sides of a pump support body and each being operated by the same eccentric and needle bearing assembly such that when one deformable pump chamber is engaged in its fluid compression or pumping operation the opposite deformable pump chamber is undergoing expansion for suction of additional fluid material through its inlet check valve.

It has been determined that, though zinc particulate will adhere to most metal surfaces and many other surfaces as well, it does not have an affinity for adherence to titanium surfaces. For this reason the ball check members of the check valve assembly are each composed of stainless steel having an external coating of titanium carbide thus providing a durable check valve surface which will remain clear of any buildup of metal particulate during operation of the check valve assembly. These spherical ball check elements are each seated against seat surfaces defined by polyurethane seat elements which are located in the inlet and outlet flow passages of the check valve assembly. Ordinarily pump mechanisms designed for high pressure operation are provided with non-resilient seats composed of stainless steel or other suitable metal and thus being unyieldable. It has been determined that compression of the zinc material against a metal seat will cause the zinc material to buildup on the seat to the point where it interferes with check valve seating. Periodically the metal seat buildup will slough away from the seat structure and pass down stream to the spray gun in a rather hardened mass or globule which can interfere with proper spraying activity and which can in some cases does block the spray gun passages and prevents proper operation thereof. It has been determined that the provision of a spray nozzle seat having a degree of resiliency will prevent buildup of metal particulate on the seat surfaces. As the ball check member engages the seat surface under high pressure the seat surface will be deformed by the ball check. When the ball check member is moved away from the seat by a flow through the check valve under suction or pressure the seat surface will return to its original configuration. Each time the seat is compressed and then returns to its original form any metal particulate that might have become deposited on the seat surfaces will slough away. Since adhered metal particulate from the seat sloughs away at each operational cycle of the check valve, for example 100 times per minute or more, any metal buildup that is present will be continually flushed away from the seat surface. Thus this metal particulate remains sufficiently small that it will easily pass through the nozzle of a spray gun for efficient spraying thereof and without interfering with the spray pattern of the gun.

For the reason that the deformable pumping tubes operate cyclicly, both the inlet and discharge lines of the check valves will pulsate as pumping activity occurs even though little or no metallic coating material may be flowing therethrough. This pulsating activity provides these flexible flow lines with continuous pulsation during operation of the pump mechanism thereby continuously agitating the carrier/metal particulate suspension within the flow line and maintaining its optimum characteristics for efficient spraying.

A spray gun is then connected to the discharge end of a supply conduit and is provided with a packingless operating trigger stem having a polymer body that functions as a columnar spring and is linearly compressed during trigger actuated linear movement of the stem which occurs when the spray gun trigger is manually actuated for spraying. When the trigger stem force is released the polymer body will return to its original configuration by the inherent memory of the polymer material from which it is composed, with sufficient force to drive the trigger stem to its valve closing position. Since the spray gun will not have the usual trigger stem packings the presence of the water based metal particulate coating material within the spray gun will not cause excessive spray gun wear. Moreover, the trigger stem and various other components of the spray gun mechanism will have titanium carbide surfaces so that metal particulate adherence will not be a problem. Thus, the spray gun may be operated continuously over long periods of time while providing efficient spraying activity. The spray system will therefore have very little down time due to any requirements for repair and cleaning.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which:

In the drawings:

FIG. 3 is a partial sectional view of the pump mechanism of FIGS. 1 and 2 which illustrates one of the pump chamber housing assemblies thereof and its assembled relation with a check valve head assembly and its driven relation with the eccentric drive mechanism of the pump.

FIG. 4 is a sectional view taken along line 4—4 of FIG. 3.

FIG. 5 is a fragmentary sectional view of the deformable pump tube of FIGS. 3 and 4 showing the radially collapsed position thereof during the pumping section of its cyclic operation.

FIG. 6 is a sectional view of one of the check valve heads of the check valve head assemblies of FIG. 1.

FIG. 9 is a sectional view of a liquid supply container having an agitation and suction pick-up assembly of the present invention in operative assembly therewith.

FIG. 10 is a partial sectional view of the supply container of FIG. 10 showing the upper portion of the motor driven liquid agitator thereof in detail.

FIG. 11 is an isometric illustration showing the suction pick-up stabilizer element of FIG. 9 in detail.

DETAILED DESCRIPTION OF PREFERRED EMBODIMENT

Figure 2:
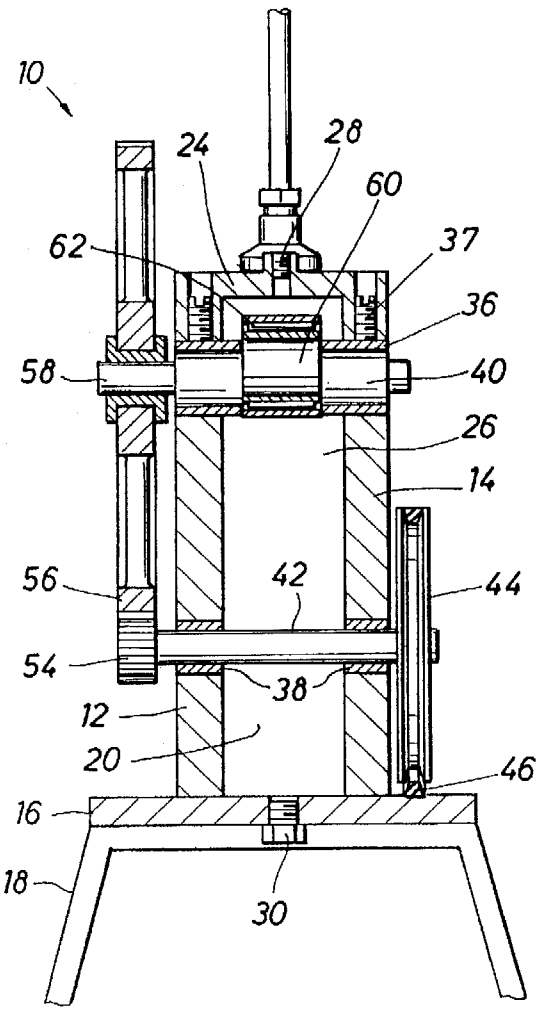
FIG. 2 is a sectional view taken along line 2—2 of FIG. 1 and showing the eccentric drive mechanism and motor driven belt/reduction gear system for the pump mechanism of FIG. 1.
Figure 1:
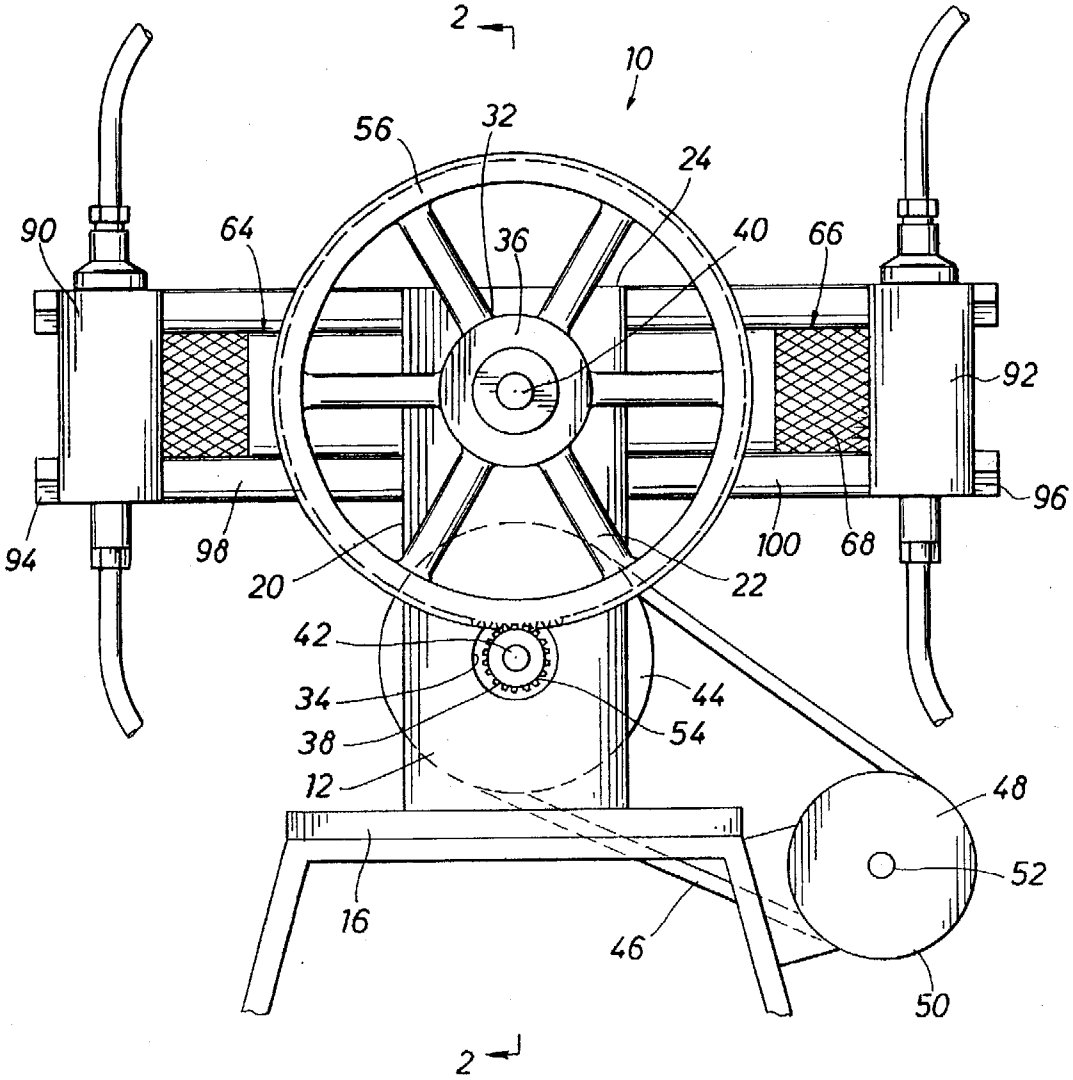
FIG. 1 is an elevational view of a packingless pump mechanism constructed in accordance with the present invention and showing a pair of opposed pump chambers and check valve heads being retained in fixed assembly with a pump support housing thereof.

Referring now to the drawings and first to FIGS. 1 and 2 a packingless pump mechanism constructed in accordance with the present invention is illustrated generally at 10 and is provided with a pump support housing having a pair of housing side plates 12 and 14 that are disposed in generally parallel relation and which are secured to a base plate 16. The base plate is adapted to be supported by a pump frame structure which is partially shown at 18. The pump support housing structure also defines a pair of end walls 20 and 22 which are bolted or otherwise fixed to the side plates 12 and 14. The upper end of the pump support housing is closed by a top wall 24. It should be borne in mind that the generally rectangular pump support housing structure may be of integral construction if desired, being initially cast or forged and then being machined to its finished condition. The pump support housing defines an internal chamber 26 which serves as a lubricating chamber, containing a quantity of lubricant for lubricating the bushing and bearing assemblies thereof. The top wall 24 is provided with a lubricant inlet opening which is closed by a plug member 28. The plug member 28 is removed for introduction of lubricant into the chamber 26. At its lower end the pump support housing defines a drain opening which is closed by a drain plug 30 thereby permitting the lubricant to be periodically drained from the lubricant chamber and replaced as appropriate to maintain clean lubricant for the bearings and shafts that are located within the pumpsupport housing.

The side walls 12 and 14 of the pump support housing each define upper and lower bearing openings such as shown at 32 and 34 which receive respective bearing assemblies 36 and 38 to provide rotational support for an upper eccentric drive shaft 40 and a lower idler shaft 42. At one end of the idler drive shaft 42 is fixed a driven sheave 44 which is driven by a drive belt 46 that extends about a drive sheave 48 being powered by a suitable motor 50 having a motor output shaft 52. The drive motor 50 is preferably an air driven motor since many spray pump mechanisms are air driven. In the alternative however the drive motor 50 may conveniently take the form of an electrically driven motor or an internal combustion engine, depending upon the needs of the user.

The idler shaft 42 is machined at one end with a drive gear 54 which is coupled in driving relation with a driven gear 56 that is secured in non-rotatable relation to a drive connection end 58 of the eccentric drive shaft 40. Thus, as the output shaft 52 of the drive motor 50 is rotated the belt drive assembly in parts driving rotation to the idler shaft 42 which in turn, drives the reduction gears 54–56, causing relatively slow rotation to the eccentric drive shaft 40 as to compared to the output shaft 52 of the drive motor. It has been determined that drive ratio of the pinion gears 54 and 56 in the range of 74 to 1 establishes a fairly optimum rotational speed of the eccentric drive shaft. The gear reduction and the belt drive reduction will establish rotational speed range of the eccentric drive shaft from 100 to 500 rpm when the output shaft of the drive motor has a rotational output speed in the range of 3000 rpm. With the reduction gear and belt drive system shown in FIG. 2 changes in the speed of the eccentric drive shaft 40 may be simply achieved by changing out one or both of the belt drive sheaves 44 and 48.

Intermediate the eccentric drive shaft 40 is provided an eccentric member 60 which is integrally defined on the rotary shaft 40. In conjunction with the pump mechanism of the present invention it has been determined that the eccentric member 60 should have an eccentric movement or throw in the range of about 0.004". This particular dimension of throw however is not intended to limit the spirit and scope of the present invention because the eccentric throw can be varied substantially without departing from the operational and functional concept of this invention. The eccentric member 60 is provided with an external needle bearing 62 for establishment of optimum force transmitting engagement with a pusher member to be discussed hereinbelow.

Virtually all pump mechanisms for pumping paint and other coating materials incorporate pistons for pumping activity which are reciprocated by piston stems that are driven by air motors or by any other suitable means. These piston stems typically move through packing assemblies that maintain a sealed relation of the piston stem relative to wall structure of the pump housing. As mentioned above, in the case of pumping water based zinc coating material as well as other paint or coating materials having metallic particles therein, the metal particulate can tend to buildup on metal surfaces such as the piston stems. As the metal particulate plates out or becomes deposited onto the piston stems the metal buildup, being somewhat rough and abrasive, passes through the stem packings and causes accelerated packing wear. In the pumping of water based zinc coating material it is not unusual for the new packings of a pump mechanism to become worn to the point of replacement within one days service or less. It is desirable therefore to provide means for insuring adequate pumping of water based metallic coating materials without the consequent packing wear that ordinarily occurs. This feature is effectively accomplished according to the present invention by the provision of at least one and preferably a plurality of a packingless, deformable pump housing assemblies shown generally at 64 and 66, one of which being shown in greater detail in FIG. 3. Each of the pump housing assemblies defines a generally cylindrical tubular housing 68 having opposed open ends 70 and 72. A deformable generally tubular pump element 74 is extended through the open end 72 of the tubular pump housing 68 and is provided with an external retainer flange 76 which is secured in assembly with the tubular pump housing by a retainer element 78 having threaded connection with an external threaded section 80 at the open end 72 of the tubular pump housing. The retainer element 78 defines a circular thrust shoulder 82 which bears against the external retainer flange 76 of the deformable pump tube 74 and secures it tightly against a circular, generally planar shoulder 84 provided at the open end 72 of the tubular pump housing. A sealing element 86 is employed to establish positive sealing between the retainer flange 76 and the planar end surface 84 of the tubular pump housing and a sealing element 88 is employed to maintain positive sealing between the retainer element 78 and the tubular pump housing 68.

The tubular pump housing is maintained in fixed relation with the respective walls 20 and 22 of the pump support housing by a pair of check valve heads 90 and 92 which are connected by bolts 94 and 96 respectively to a plurality of stanchion members 98 and 100 that are in turn fixed to the respective walls 20 and 22 of the pump support housing structure. The check valve heads each define recessed, generally planar pump housing seats 102 as shown in FIG. 3 which are of circular configuration for receiving a circular outer sealing end 104 of the tube retainer element 78. A circular sealing element 106 is contained within a circular seal groove of the retainer element 78 and establishes a positive seal with the planar seat surface 102 thus sealing the check valve heads against the tubular pump housing assembly. At its opposite or inner end the tubular pump housing is seated against the housing wall 22 and is provided with a concentric projection 103 which is received with an opening 105 of the housing wall and sealed therewith by a circular sealing element 107. An outer end portion 108 of the deformable pump tube 74 projects beyond the external retainer flange 76 thereof and is located within the sealing portion 104 of the retainer 78 and in abutting relation with the planar seat surface 102.

The deformable pump tube 74 defines an elongate generally tubular section 110 of tapered, generally frustoconical configuration and having the free extremity thereof closed by means an integral transverse wall section 112. The tapered wall section 110 of the deformable pump tube is adapted to be radially collapsed by application of external force thereto so as to forcibly diminish the volume of an internal pumping chamber 114 of the pump tube. In order to enhance the pumping capability of the deformable pump tube, by insuring its capability of controlled radial compression or collapse, the pump tube is provided with a plurality of internal elongate grooves 116 which extend generally along the length of the tapered wall section thereof. When the deformable pump tube is radially deformed by external force the internal grooves 116 will collapse in the manner shown in the fragmentary sectional view of FIG. 5 thereby permitting significant radial compression of the tubular pump element without subjecting the polymer material thereof to significant internal stress. By providing the polymer pump tube with internal grooves, such as shown in 116, the tube can be repeatedly collapsed and expanded as needed during pumping activity without becoming ruptured by internal stress fatigue of the polymer material. Although the internal longitudinal grooves 16 are shown to be of generally rectangular configuration this configuration is not intended to limit the spirit and scope of this invention. The internal grooves 116 may have any other cross-sectional configuration that permits efficient collapse thereof essentially as shown in FIG. 5 without departing from the spirit and scope of this invention. As mentioned above, the tubular pump housing 68 is provided with a pusher element 118 which is of elongate, generally tubular configuration and defines an external cylindrical surface 120 which is maintained in sealed relation with respect to the tubular pump housing by means of a pair of circular sealing elements 122 and 124 which are retained within internal seal grooves of the housing 68. The pusher element 118 defines an integral transverse force transmitting wall 126 which defines the closed end of the pusher element and also defines a force transmitting wall which is maintained in continuous engagement with the external needle bearing assembly 62 of the eccentric cam element 60. Thus as the cam 60 is rotated its eccentric throw will impart linear movement to the pusher element 118 thus moving the pusher element linearly in a direction away from the eccentric cam. This cam induced linear movement of the pusher element establishes the pumping stroke of the pump achieves force induced linear and radial collapse or compression of the deformable pump tube 74 to diminish the volume of its internal pumping chamber 114 and expel a quantity of fluid from the pumping chamber through a check valve head mechanism as will be described below.

It is desirable to insure substantially even radial compression or collapse of the deformable pump tube along its length without causing any portion of the pump tube to be excessively stressed. Thus it is desirable to provide for an even application of tube collapsing force from the pusher element 118 to the external surface area of the deformable pump tube. This feature is efficiently achieved by providing the pump mechanism with a hydro-mechanical pumping capability. This feature is achieved by defining a conical internal wall surface 126 within the pusher element 118 which is disposed in essentially evenly spaced relation with the tapered external wall surface 128 of the deformable pump tube thus defining an internal annular chamber 130 between the spaced conical surfaces 126 and 128. This internal annular chamber is also defined in part by an external end surface 132 of the integral transverse wall section 112 of the pump tube and an internal transverse wall surface 134 that is defined by the transverse end wall 126 of the pusher element 118. A quantity of hydraulic fluid fills the annular chamber 132 and thus contacts the external surfaces 130 and 132 of the deformable pump tube. When the pusher element 118 is moved linearly by the cam 60 and its needle bearing assembly 62, the pusher movement is transferred to the hydraulic fluid within the chamber 132. This causes an increase in pressure of the hydraulic fluid and thus causes this fluid pressure increase to be applied evenly over the entire external surface area of the deformable pump tube element. When this occurs, even radial compression of the pump tube element is induced by the hydraulic fluid and the pump tube becomes collapsed from the FIG. 4 condition thereof toward the FIG. 5 condition thereof, thus diminishing the volume of the internal pump chamber 114 and causing expulsion of the liquid from the pump chamber through the check valve assembly. A bleed valve 136 is threadedly connected within an internally threaded opening through the wall structure of the tubular pump housing 68 and is in communication with the internal hydraulic fluid chamber 132. When the deformable pump tube is installed a quantity of hydraulic fluid is introduced into the tapered chamber of the pusher element and the pump tube is then put in place and secured by the retainer 78. In the event any air is present within the hydraulic chamber 132 or in the event the chamber contains excessive hydraulic fluid the bleed valve 136 may be opened to bleed all of the air out of the hydraulic chamber and to bleed away any excess of hydraulic fluid.

Normally when a pump encounters a high suction head the pump will cavitate, developing a negative pressure bubble in the fluid. When the polymer pump tube expands, subsequent to the pumping section of its stroke or cycle, by virtue of the inherent memory of its polymer material the liquid within the check valve head that is located upstream of the discharge check valve will be subjected to the suction that is developed by the expanding pumping chamber. If the liquid under suction is somewhat immovable the suction pressure applied by the resilient memory of the pump tube will be limited. Thus insufficient suction force will be developed to achieve a cavitation bubble. Therefore the pump mechanism of this invention is an anti-cavitation pump even though it is capable of developing high discharge pressure such as 5000 psi or greater.

Each of the check valve heads 90 and 92 is provided with a check valve housing 138 defining inlet and outlet retainer recesses 140 and 142, having a pump chamber opening 143 and defining a plurality of transverse bolt passages 144, 146, 148 and 150 which intersect the respective inlet and outlet retainer recesses 140 and 142. An inlet retainer element 152 is positioned within the inlet retainer recess 140 and is secured therein by a lower pair of tapered bolt members 94/96 which extend through the bolt passages 146 and 150 and engage within a circular retainer groove 154 having a circular cross-sectional configuration corresponding to the cross-sectional configuration of the retainer bolts 96. The inlet retainer element 152 is sealed with respect to the check valve body 138 by means of a circular sealing element 156. The inlet retainer element 152 serves to secure the retainer flange 157 of an inlet valve seat 158 in firmly retained engagement with an internal seat support shoulder 160 defined within the check valve body. A support plate 159 defining a central opening provides support for the inlet seat element 158 within the check valve housing. A seal member 159 maintains the inlet seat retainers in sealed assembly with the check valve housing. A ball check member 162 is positioned in sealing engagement with a tapered seat surface 164 of the seat member 158 the ball check member 162 permits introduction of liquid past the tapered seat surface 164 under suction developed by the deformable pump tube 74. The ball check member will seal firmly against the tapered seat surface 164 when the pump tube expels fluid and increases pressure within the check valve housing downstream of the inlet seat surface. Thus, it is seen that the bolts 96, which secure the check valve head 92 to the stanchion members 100 and the tubular pump housing 68, also function to secure the seat retainer element 152 in its firmly seated and sealed relation with respect to the check valve body 138. The retainer bolts 96 are tapered along their length and, when forcibly inserted through the bolt openings 146 and 15, urge the retainer insert against the retainer flange of the seat member 158 to thus positively retain the inlet seat at the position shown in FIG. 6. An outlet or discharge seat retainer element 166 is secured within the outlet retainer recess 142 by means of other tapered retainer bolts 96 which extend through portions of a circular retainer groove 168 having a cross-sectional configuration similar to that of retainer groove 154 of the inlet seat retainer 152. The retainer bolts 96 also secure the outlet retainer 166 in sealed relation with the check valve body 138 by means of a circular sealing element 170. The outlet retainer 166 also serves to retain a discharge seat element 172 in firmly seated relation against the external retainer flange 171 of the outlet seat 172. A seat support plate 173 is seated on an internal seat support shoulder 175 defined with the check valve body 138. The outlet or discharge valve seat 172 defines a tapered seat surface 176 which is engaged for sealing by a ball check element 178 to thus provide for unidirectional discharge of liquid material through the outlet passage 180 of the outlet retainer element 166 under the influence of pressure generated by the deformable pump tube 74 as it is hydrodynamically deformed by the pusher element 118 under the force generated by the eccentric cam 60.

Each of the valve seat elements 158 and 160 is composed of a somewhat flexible polymer material, such as polyurethane for example, and are capable of being flexed under forcible sealing engagement by the respective inlet and outlet ball check members 162 and 178. Under the influence of pressure induced force the ball check members will cause the respective seat elements to be flexed somewhat. As the ball check members are unseated to permit flow past the respective seat elements the resilient seat members will unflex. When this occurs, any metal particulate that might have been compressed between the ball check members and the respective seat elements will slough away and will be flushed downstream by the fluid flowing at relatively high velocity across the seat surface. This feature keeps the respective seat surfaces substantially free of any metal particulate buildup and maintains optimum seating capability thereof. The seat elements 158 and 172 define seat surfaces on each side thereof. Thus, in the event one of the seat surfaces of either of the seat elements becomes fouled to the point that improper sealing occurs that seat element can simply be taken out, reversed and reinstalled. Further, the seat elements of the check valve heads can be simply and efficiently changed out in field conditions without requiring special tools.

Ordinarily the pumps of liquid spray systems such as paint or coating systems incorporate check valves within the head structure of the pump. Thus, in order to replace the check valves or the check valve seats it is necessary to remove the head structure from the piston and cylinder assembly of the pump and then replace the check valves. This is a tedious operation that must be accomplished in shop conditions. It is thus not practical to replace check valves and seats in the field because significant pump down time and specialized repair equipment and tools are ordinarily required for this type of repair operation.

External mounting of the check valve heads 90 and 92 and the provision of head bolt connection of the inlet and outlet retainer elements permit simple and efficient changing of the check valve seats and balls as needed. When seat reversal or seat replacement is necessary this is accomplished simply by removing the four retainer bolts 96 from the respective stanchion elements. When the bolts 96 are removed from their respective bolt passages the retainer elements 152 and 166 will be free for removal from their respective retainer recesses. When the retainer elements are removed the respective seat elements 158 and 172 are exposed and can be simply removed and either inverted for further use or replaced.

Because of the propensity of zinc particulate and other metal particles to adhere to metal surfaces, the ball check members 162 and 178 are preferably composed of stainless steel which is coated with titanium carbide. It has been surprisingly determined that zinc and other metal particulate has no tendency of adherence to titanium carbide surfaces. These surfaces are quite wear resistent and will permit extended use before the ball check members must be replaced. Replacement of the ball checks is a simple operation which is accomplished by removing the seat elements as described above and then removing and replacing the ball check members. In the event the check valve heads should become fouled with the liquid material being pumped the entire check valve head assembly may be removed from the pump and separated into its various components for efficient cleaning. All of these activities can be carried out in field conditions without necessitating the use of special equipment and without necessitating significant pump down time.

As mentioned above, the metal particulate of certain coating compositions, especially zinc particulate, has an affinity for metal surfaces and will tend to plate out onto such surfaces during handling of the coating composition. In virtually all cases, spray guns for paint, coating compositions and other similar materials are provided with trigger actuating stems that are operated linearly by a trigger to accomplish movement of a valve control needle in relation to a spray nozzle opening for controlling spraying of the liquid. In most cases, such as taught by U.S. Pat. No. 3,379,376, the valve operating stem is reciprocated through a spray gun packing as it is cycled by the trigger of the spray gun. When the metal particulate builds up on the metal valve operating stem a roughened stem surface is presented to the packing which causes erosion of the packing as the stem is repeatedly cycled. In the case of zinc particulate the zinc continues to build up on the trigger stem as the duration of spraying continues thereby causing greater and greater stem dimension to be presented to the packing as metal buildup progresses. The trigger or valve operating stem will thus quickly erode the packing causing packing leakage to begin. When this occurs the spray gun must be disassembled and the packing replaced. It may also be necessary to replace the trigger stem because of the metal buildup on the stem. At the very least, the trigger stem must be cleaned of metal particulate buildup. When water based zinc coating compositions are being sprayed it is typically necessary to stop the spraying process several times a day in order to clean the spray gun of metal buildup and to replace or tighten the spray gun packings to minimize leakage. One attempt to solve the packing erosion problem is identified by U.S. Pat. No. 4,126,321 of Harjar, et al. which discloses a packingless bellows seal between an opening into the coating material conduit in the barrel of the spray gun and a pull rod which extends into the conduit through the opening to control a valve in the conduit. This bellows seal permits linear movement of the pull rod and yet maintains a seal during such movement. In the handling of water based metallic coating compositions, especially zinc coating material the metallic particulate of the coating composition will tend to build up in the grooves of the bellows when the bellows is compressed. Each time the bellows becomes fully compressed metal particulate trapped within the bellows grooves will be compressed and will define metal flakes or globules that pass down stream with the product and interfere with spraying activity or buildup in the grooves to the point that the bellows will not fully collapse. Obviously the bellows will not withstand significant pressure differential without rupturing. When high pressure spraying, such as in the range of 5000 psi, for example, a bellows seal would quickly fail. These are significant disadvantages which are overcome by the present invention.

Figure 7:
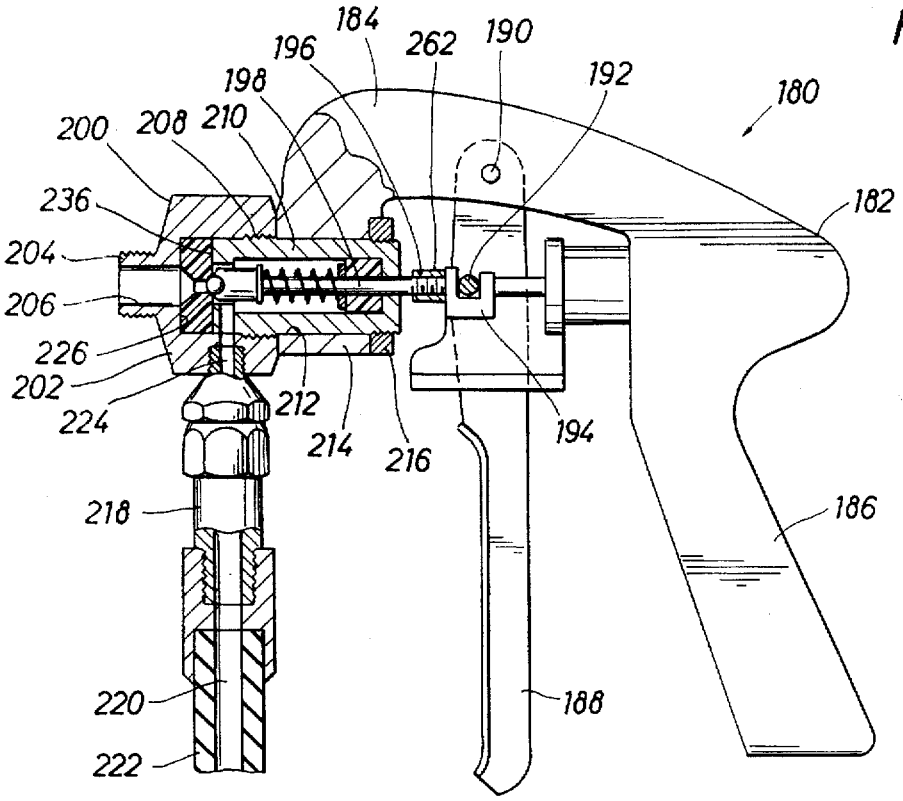
FIG. 7 is a partial sectional view of a packingless spray gun which is constructed in accordance with this invention.
Figure 8:
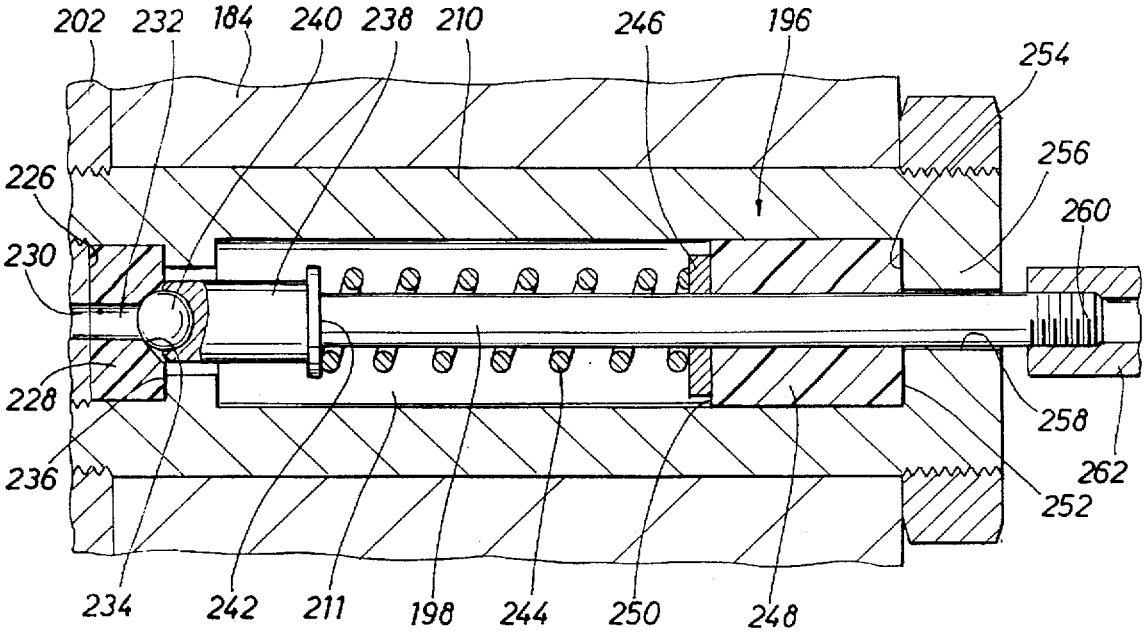
FIG. 8 is a fragmentary sectional view of the packingless spray gun of FIG. 7 showing the trigger valve stem thereof in detail.

Referring now to FIGS. 7 and 8, a packingless spray gun assembly constructed in accordance with the present invention is shown generally at 180 and incorporates a spray gun frame 182 having a spray gun head 184 and handle 186. A trigger element 188 is pivotally connected to the spray gun head by a pivot pin 190. A drive pin 192 extending transversely at the trigger 188 is received by the drive receptacle 194 of a valve actuating stem assembly 196. The stem assembly is interconnected in driving relation with a valve stem 198 which is positioned for reciprocating movement within a spray nozzle assembly 200. The spray nozzle assembly defines a nozzle head 202 having an externally threaded projection 204 which defines a portion of a spray orifice 206 and which is adapted to receive a suitable orifice fitting that determines the spray pattern of the spray head. The spray head 202 is threadedly connected at 208 to a nozzle body 210 which extends through an opening 212 in a nozzle support section 214 of the spray gun head 184. A nozzle retainer element 216 is received by an externally threaded section of the nozzle body 210 and serves to secure the nozzle body and thus the nozzle assembly in fixed relation with the head portion 184 of the spray gun frame 182. A fluid supply fitting 218 is threadedly connected to the nozzle head 202 and communicates the supply passage 220 of a supply hose 222 with a supply inlet passage 224 of the nozzle head.

As shown in greater detail in FIG. 8 the nozzle head 202 defines an internal seat receptacle 226 against which is seated a yieldable valve seat element 228 which is composed of a flexible polymer material such as polyurethane or any other suitable yieldable seat material. The spray nozzle seat element defines a discharge passage 230 which is in communication with the discharge passage section 232 of the resilient seat element, The discharge passage section 232 is intersected by a tapered valve seat surface 234. The resilient seat element 228 is secured within the seat receptacle 226 by a retainer shoulder 236 which is defined at one end of the nozzle body element 210.

As shown in FIG. 8 the valve stem 198 of the spray gun assembly is provided with a valve support element 238 having a spherical valve element 240 retained in fixed relation at one end thereof and oriented for sealing engagement with the tapered valve seat 234 of the seat element 228. The seat element is typically composed of a durable polymer such as polyurethane to minimize wear and to ensure against metal particle buildup during metal particulate spraying. The valve support element includes a polymer washer 241 which defines a circular shoulder 242 which is engaged by one end of a coil type compression spring 244 that surrounds an intermediate section of the valve stem 198. The opposite end of the compression spring is received in force transmitting engagement with a thrust element 246 such as a thrust washer. The compression spring provides the force for maintaining the spherical valve element 240 in normal seating engagement with the tapered sealing surface to prevent flow through the nozzle discharge passages 230 and 232. To open the valve, the trigger 188 will be pivoted to the right as shown in FIG. 7, thereby causing the transverse drive pin 192 to move the valve stem 198 linearly to the right as shown in FIG. 8 for unseating the valve element 240 from the tapered seat surface. Obviously very little linear movement of the valve stem is needed for unseating the valve element and permitting fluid spraying activity to occur under the pressure that is generated by the packingless pump assembly of FIG. 1.

As mentioned above, it is desirable to eliminate the need for a valve stem packing in the spray gun assembly to prevent the packing damage that typically occurs when valve stems having metal particulate adhered thereto are moved through packing assemblies. Accordingly, as shown in FIG. 7 and as shown in detail in FIG. 8 the valve stem 198 is provided with a generally cylindrical resilient sealing body 248 which is composed of a resilient material such as polyurethane or any one of a number of other suitable resilient polymer or rubber materials depending upon the intended use. One end of the resilient sealing body 248 defines a substantially planar end abutment surface 250 which is positioned in abutting relation with the force transmitting washer 246. The opposite end surface 252 of the resilient sealing body is positioned in supported abutting relation with an internal support shoulder 254 of an end wall 256 of the nozzle body 210. The valve stem 198 extends through an opening 258 of the end wall 256 and defines an externally threaded section 260 which is received by a valve stem actuator 262. As shown in FIG. 7 the valve stem actuator is driven by the drive receptacle 194 under the force of trigger 188 being applied through the transverse drive pin 192. Thus, as the trigger 188 is manually actuated, the valve stem 198 will be moved to the right as shown in FIG. 8, thereby unseating the titanium carbide ball 240 from the tapered seat surface 234 of the valve seat. When this occurs the flow of pressurized fluid from the valve chamber 211 through the spray nozzle of the gun will occur. As mentioned above, since seat element 228 is of flexible nature any metal particulate that might have been squeezed between the valve ball 240 and the tapered seat surface will separate from the seat surface by virtue of the seat returning to its original configuration by the inherent memory of its polymer material. This "unflexing" of the seat member will cause any metal particulate that is present on the tapered seat surface to slough away and pass down stream through the discharge passage 232 each time the spray valve opened it will essentially clean itself of any accumulated metal deposits. Thus the life of the seat element 228 will be significantly enhanced as compared to conventional spray gun assemblies of this nature. The resilient spring-like body of polymer material 248 will simply be compressed as a columnar spring each time the spray valve is opened and virtually no metallic spray composition will enter the interface between the resilient spring-like body and the valve stem 198. Thus, the resilient body 248 functions as a columnar spring to provide the valve with a closing force which enhances the closing force of the compression spring 244. To minimize the possibility of metal buildup within the valve chamber 211 the valve stem member 198 will be composed of stainless steel or other suitable metal having an outer layer of titanium carbide thereby presenting a titanium carbide surface to which the metallic spray composition does not have an affinity for adherence. If desired, other surfaces of the spray gun assembly which are contacted by the metal particulate coating composition, such as the interior surface of the nozzle body 210 for example may be provided with a coating of titanium carbide to prevent metal particulate adherence.

As mentioned above, especially in the case of water based metallic coating compositions and in particular water based zinc coatings, the liquid carrier is of insufficient viscosity to entrain the metal particulate for any significant period of time. Typically the coating composition is mixed at the time of its use and placed within a supply container having sufficient volume for commercial use. In practice, commercial users often employ inexpensive and light weight 5 gallon containers or buckets within which to mix the coating composition. The suction hose of the spray pump is then extended to the container and the suction end of the hose is immersed in the liquid coating composition. Also in practice, especially when water based zinc coating is employed, the zinc particulate, being quite dense, will tend to rapidly fall out of suspension and settle to the bottom of the container. It is of course desirable to insure that the coating composition remains properly mixed at all times during spraying activity. For this reason the liquid coating composition within the supply container must be frequently agitated by stirring. It is desirable to provide means that can be employed with these inexpensive light weight supply containers and which accomplishes continuous stirring of the coating composition so that its metal particulate will remain in proper suspension at all times.

Apparatus for continuous stirring of liquid materials to be sprayed has been developed as indicated by U.S. Pat. No. 2,959,358 of Vork. In this case however, the supply container and suction mechanism is of quite complex and expensive nature and thus can be unsatisfactory for various types of commercial spraying. According to the present invention, as shown in FIGS. 9–11 the liquid spraying assembly will incorporate a continuously agitated liquid supply system shown generally at 270 which utilizes a conventional liquid supply container 272 which may be defined by a shipping container or bucket composed of any suitable polymer or metal material. The container 272 may be of the 5 gallon variety or it may have any other suitable volume depending upon the needs of the user. These polymer containers or buckets are readily available since they frequently serve as shipping containers for paint, coating materials and other liquid or granulated products. It is desirable to insure continuous agitation of the zinc or other metallic coating composition within the supply container so that it may be used efficiently to produce optimum protective coatings. It is also desirable to insure adequate pick-up or suction of the liquid material from the container and to provide for its controlled delivery via the packingless pump mechanism of FIG. 1 to the packingless spray gun system of FIGS. 7 and 8. If an agitator and a suction conduit were simultaneously placed within a supply container, the suction tube could come into contact with the impeller of the agitator thereby causing damage to the agitator or the suction pick-up or both. It is desirable therefore to provide means for adequately supporting an agitator in releasable assembly with the supply container 272 and to provide for location of a suction pick-up within the container in such manner that it cannot come into contact with the impeller of the agitator. These features are effectively provided as shown in FIG. 9 and is shown in greater detail in FIGS. 10 and 11. An agitator assembly shown generally at 274 is provided with a mounting base plate 276 which is adapted as shown in FIG. 9 for installation to the upper edge 278 of the supply container 272. As shown in FIG. 10 the mounting base plate 276 defines a slot or receptacle 280 which is preferably of curved configuration so as to receive the curved upper edge 278 of the container 272. A pair of stabilizing pins 281 project downwardly from the mounting base plate 276 and are positioned for engagement with the inner surface of the supply container. These stabilizing pins are typically in threaded engagement within threaded holes in the mounting base plate and serve to minimize tilting movement of the mounting base plate when the agitation assembly is mounted to the supply container as shown in FIG. 9. The mounting base plate also defines at least one and preferably two or more threaded openings 282 within which are received locking bolts 284 that may be tightened against the upper edge of the container so as to secure the mounting base plate in releasable but substantially fixed assembly with the upper edge portion of the container.

The mounting plate 76 defines a plurality of openings through which extend mounting bolts 286 for securing an agitator drive motor 288 which preferably takes the form of an air energized motor. It should be borne in mind however that any other type of motor such as electric motor, hydraulic motor, etc. may be employed without departing from the spirit and scope of this invention. The air motor 288 imparts rotation to a rotary drive shaft 290 which extends through an opening 292 in the mounting base plate 276. An agitator shaft 294 extends downwardly from the rotary drive shaft 290 and is provided with an agitator impeller 296 at the lower end thereof. The agitator shaft 294 is of such length that the impeller 296 is positioned near but not in contact with the bottom wall 298 of the container. The mounting base plate 276 positions drive motor 288 such that the impeller 296 is located off center within the supply container so that the agitator can impart a swirling action to the liquid product of the container. The swirling action together with significant turbulence developed by the agitating impeller will keep the metal particulate of the coating composition in evenly disbursed suspension at all times.

The liquid supply apparatus 270 is provided with a suction tube 300 having a filter element 302 located at the lower end thereof. As suction is applied through the suction tube 300 by the negative pressure or suction of the packingless pump assembly of FIG. 1 the coating composition within the supply container 272 will be drawn through the filter 302 and will be permitted to flow through the suction tube 300 in route to the suction of the pump. The filter 302 will exclude any debris that might be present in the container from the suction tube 300. The filter 302 will also filter out any metal globules that might be present within the supply container and might interfere with the spray system. Typically the suction tube 300 will be of flexible nature. It is important that the suction tube remain stabilized within the supply container and remain separated from any potential contact with the impeller 296. Unless properly supported, the turbulence of the fluid within the container which is generated by the impeller could draw the lower end of the suction tube into contact with the impeller. Accordingly, the present invention includes a suction tube stabilizer which is shown generally at 304 in FIG. 11 by way of isometric illustration. The suction tube stabilizer is also shown in FIG. 9 in retaining assembly with the container 272 and in stabilizing relation with the suction tube 300. The stabilizing element may be defined by a single length of relatively stiff wire which is formed into a loop and then shaped to the configuration shown in FIG. 11. The stabilizer 304 defines a pair of elongate stabilizing rod sections 306 and 308 which are disposed in spaced relation and which engage side surface areas of the suction tube 300 to maintain it in substantial alignment with the internal wall surface of the container 272. At its lower end the stabilizer 304 defines an offset loop section 310 of generally U-shaped configuration which is angulated relative to the rod elements 306 and 308 at an angle of about 135°. The loop section 310 extends about the suction tube 300 as shown in FIG. 9 and serves to retain the suction tube in juxtaposed relation with the sidewall of the supply container. At its upper end the stabilizer element 304 defines inverted U-shaped sections 312 and 314 which extend over an upper end portion 316 of the suction tube assembly. The inverted U-shaped sections 312 and 314 also serve as retainers to mount the suction tube stabilizer to the upper end portion of the container 272. The stabilizer is completed by stabilizer positioning rod sections 318 and 320 and a curved lower interconnecting section 322. The positioning rod sections 318 and 320 will engage outer circular portions of the container such as the peripheral rib or flange 324 and will provide a spring-like function to secure the upper end portion of the suction tube 300 in relatively tight fitting engagement within the upper end of the supply container. The stabilizer element 304 is typically of spring-like nature so that it can spring slightly as it secures the suction tube to the inside of the supply container. Even though the container may vibrate somewhat due to operation of the impeller therein and the turbulence of the agitated liquid, the stabilizer element will retain the suction tube in positively located relation within the container so that the suction tube will remain within the container at all times.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all embodiments which come within the meaning and range of the equivalence of the claims are therefore intended to be embraced therein.

What is claimed is:

1. A pump mechanism, comprising:

(a) pump housing means defining a housing chamber;

(b) a generally tubular deformable pump element being composed of a resilient material having a resilient memory being located within said housing chamber and defining a closed pumping end, an internal variable volume pumping chamber and inlet and discharge opening means for said internal variable volume pumping chamber, said deformable pump element having a normal non-deformed state where said variable volume chamber has a maximum volume and a deformed state where said variable volume pumping chamber has a volume less than said maximum volume;

(c) a pusher element being linearly movable within said housing chamber and having a pusher chamber receiving said closed pumping end of said deformable pump element, (d) means imparting periodic pushing force to said pusher element for forcible linear collapsing movement of said resilient deformable pump element, said collapsing movement reducing the volume of said pumping chamber for discharging fluid therefrom, in absence of said periodic pushing movement said resilient deformable pump element being expanded to said non-compressed state thereof by said resilient memory; and (e) pump valve means controlling inlet of fluid to said variable volume pumping chamber and controlling discharge of pumped fluid from said variable volume pumping chamber.

2. The pump mechanism of claim 1, further comprising:

(a) said deformable pump element defining an outer surface area; and (b) a hydraulic fluid layer being interposed between said outer surface area of said deformable pump element and said pusher element and transferring force of said pusher element to said outer surface area of said deformable pump element.

3. The pump mechanism of claim 1, wherein:

(a) said deformable pump element having a generally frusto-conical external configuration;

(b) said pusher element having a generally frusto-conical internal configuration substantially corresponding to said generally frusto-conical external configuration of said deformable pump element and being spaced therefrom to define a hydraulic chamber therebetween; and (c) a hydraulic fluid substantially filling said hydraulic chamber.

4. The pump mechanism of claim 1, further comprising:

(a) spaced seal means being located within said pump housing means and establishing seals with said pump housing means and said pusher element; and (b) a fluid being interposed between said spaced seal means and being interposed between said pump housing means and said pusher element and defining a fluid bearing for said pusher element.

5. The pump mechanism of claim 1, wherein said means imparting periodic pushing force to said pusher element comprises:

rotatable eccentric means having a rotational cycle and being in force transmitting engagement with said pusher element and during a portion of said rotational cycle imparting a force to said pusher element for linear movement of said pusher element and collapse of said deformable pump element toward said collapsed state, during another portion of said rotational cycle said rotatable eccentric means relaxing said force transmitting engagement and permitting resilient memory expansion of said deformable pump element toward said non-compressed state thereof.

6. The pump mechanism of claim 5, wherein said rotatable eccentric means comprises:

(a) support means;

(b) a shaft being rotatably supported by said support means;

(c) an eccentric element being provided in said rotatable shaft;

(d) bearing means being supported by said eccentric element and defining the outer periphery of said rotatable eccentric means, said being means being in engagement with said pusher element.

7. The pump mechanism of claim 6, further comprising means connected in driving relation with said rotatable shaft and imparting pump driving rotation to said rotatable shaft.

8. The pump mechanism of claim 7, wherein said means connected in driving relation with said rotatable shaft comprising:

(a) pump drive support means having said rotatable shaft in rotatable support therewith;

(b) a driven gear being fixed to said rotatable shaft;

(c) an idler shaft being rotatably supported by said pump drive support means;

(d) a drive gear being fixed to said idler shaft and having geared driving interconnection with said driven gear;

(e) an air driven pump motor having a rotatable output shaft; and (f) a belt drive interconnecting said rotatable output shaft of said air driven pump with said idler shaft, said belt drive and said drive and driven gears defining a rotary reduction system for rotating said rotatable shaft and said eccentric at a slower rotational velocity then said rotatable output shaft of said air driven pump motor.

9. The pump mechanism of claim 1, wherein:

(a) said pump housing means defining an open extremity and having a generally cylindrical internal surface;

(b) said pusher element being of generally tubular configuration and having a closed end being exposed at said open extremity and being in force receiving contact with said means imparting periodic pushing movement, said pusher element defining a generally cylindrical external surface being in juxtaposed relation with said generally cylindrical internal surface of said pump housing means;

(c) a pair of sealing elements being disposed in spaced relation within said pump housing means and establishing spaced seals between said pump housing means and said pusher element; and (d) a quantity of lubricating oil being located between said spaced sealing elements and between said generally cylindrical internal surface of said pump housing means and said generally cylindrical external surface of said pusher element and serving as a lubricating fluid bearing therebetween.

10. The pump mechanism of claim 1, wherein:

(a) said pump housing means defining a threaded section at one end thereof;

(b) said deformable pump element defining an external retainer flange; and (c) a threaded retainer being received by said threaded section and securing said retainer flange in fixed, retained assembly with said pump housing means.

11. The pump mechanism of claim 10, wherein:

(a) said threaded retainer defining a check valve connection; and (b) a check valve assembly being secured to said check valve connection and having fluid communication with said variable volume pumping chamber, said check valve assembly having inlet and discharge check valves for controlling inlet of fluid into said variable volume pumping chamber and discharge of fluid from said variable volume pumping chamber.

12. The pump mechanism of claim 1, wherein:

(a) said deformable pump element being integrally formed of material having a resilient, rubber-like consistency and having a resilient memory sufficient to return said deformable pump element to its non-deformed state in absence of deforming force thereon, said deformable pump element further being of elongate generally tubular configuration and having a closed end facing said pusher element and having an open end;

(b) said pump valve means being check valve means disposed in sealed connection with said pump housing means and having flow passage means in communication with said open end of said deformable pump element and said variable volume internal pumping chamber;

(c) an inlet check valve and a discharge check valve being located within said flow passage means and controlling inlet of fluid to be pumped into said variable volume pumping chamber and discharge of pumped fluid from said variable volume pumping chamber.

13. The pump mechanism of claim 1, wherein said inlet and discharge check valve comprise:

(a) a check valve housing being in engagement with said pump housing means and defining inlet and outlet ports and having internal flow passage means communicating said inlet and outlet ports and having fluid transferring communication with said variable volume pumping chamber;

(b) resilient inlet and outlet seat elements being located within said check valve housing and defining portions of said internal flow passage means; and (c) inlet and outlet check elements being movably positioned within said internal flow passage means and having unidirectional flow controlling relation with respective inlet and outlet seat elements, said inlet and outlet check elements having a titanium outer surface to prevent metal particulate adherence thereto.

14. The pump mechanism of claim 13, wherein:

(a) said resilient inlet and outlet seat elements being composed of a resilient polymer material; and (b) said inlet and outlet check elements being spherical check elements.

15. The pump mechanism of claim 13, wherein:

(a) said check valve housing further defining inlet and outlet retainer recesses and defining a plurality of bolt passages;

(b) inlet and outlet retainer elements being located within respective inlet and outlet retainer recesses and having sealed relation with said check valve housing; said inlet and outlet retainer elements respectively retaining said inlet and outlet seat elements within said check valve housing and defining inlet and outlet flow passage sections and providing for connection of inlet and outlet conduits to said pump valve means; and (c) means securing said inlet and outlet retainer elements within said inlet and outlet retainer recesses and securing said check valve housing in assembly with said pump housing means.

16. The pump mechanism of claim 15, wherein said securing means comprises:

(a) pump housing support means defining pump housing seat means and having said pump housing means in engagement therewith;

(b) stanchion means extending from said pump housing support means; and (c) a plurality of retainer bolts extending through said check valve housing, securing said inlet and outlet retainer elements within said inlet and outlet retainer recesses and securing said check valve housing to said stanchion means.

17. The pump mechanism of claim 16, wherein:

(a) said inlet and outlet retainer elements define a locking recess; and (b) said retainer bolts engaging within said locking recess and releasably locking said inlet and outlet retainer elements within said inlet and outlet receptacles, said retainer bolts also establishing retaining connection with said stanchion means and securing said check valve housing to said stanchion means in retaining relation with said pump housing means.

18. The pump mechanism of claim 11, wherein:

(a) said deformable pump element defining a deformable wall structure along the length thereof, said deformable wall structure having an inner surface defining at least a portion of said variable volume pumping chamber; and (b) said deformable pump element defining a plurality of internal grooves permitting efficient radial pumping deformation.

19. The pump mechanism of claim 1, wherein:

(a) said deformable pump element being of elongate configuration and having an external tapered portion tapering to said closed end;

(b) said pusher element being of elongate tubular configuration and having a tapered internal surface substantially corresponding with said external tapered portion of said deformable pump element, said tapered internal surfaces being disposed in spaced relation and defining a hydraulic chamber therebetween; and (c) hydraulic fluid being present in said hydraulic chamber and serving to transmit force of said pusher element to said external tapered portion and said closed end of said deformable pump element.

20. The pump mechanism of claim 1, wherein:

(a) said pump housing being of generally cylindrical configuration and defining a generally cylindrical internal surface, said pump housing further having an open end and a threaded end;

(b) said deformable pump element having an open end and retainer flange adjacent said open end;

(c) a retainer element being threadedly received by said threaded end of said pump housing and securing said retainer flange in fixed relation with said threaded end of said pump housing, said retainer element further defining seat means;

(d) said pump valve means being a check valve housing having seat receptacle means receiving said seat means of said retainer element in seated and sealed relation therewith; and (e) means securing said check valve housing in fixed relation with said pump housing.

21. The pump mechanism of claim 1, wherein said pump valve means comprises:

(a) valve passage means having a fluid inlet and a discharge outlet and being in fluid transferring communication with said variable volume pumping chamber;

(b) inlet valve seat means and discharge valve seat means composed of polyurethane and being situate in fluid controlling relation with said valve passage means;

(c) inlet and discharge check valve means being disposed in respective unidirectional flow controlling relation with said inlet and discharge valve seat means and having an outer surface of titanium.

* * * * *